US005317956A

United States Patent [19]

Devenish

[11] Patent Number: 5,317,956

[45] Date of Patent: Jun. 7, 1994

[54] PIVOTING ACTUATOR AND A POP-UP TARGET INCORPORATING SAME

[75] Inventor: Donald M. Devenish, 6 Melrose Street, Rossmoyne, 6155, Australia

[73] Assignees: Devenish Engineering Pty Ltd; Donald M. Devenish, Australia

[21] Appl. No.: 856,067

[22] PCT Filed: Nov. 9, 1990

[86] PCT No.: PCT/AU90/00546

§ 371 Date: May 11, 1992

§ 102(e) Date: May 11, 1992

[87] PCT Pub. No.: WO91/07594

PCT Pub. Date: May 30, 1991

[30] Foreign Application Priority Data

Nov. 10, 1989 [AU] Australia ..... PJ 7302
Oct. 18, 1990 [AU] Australia ..... PK 2856

[51] Int. Cl.[5] ..... F01B 7/04

[52] U.S. Cl. ..... 92/68; 92/92; 49/340

[58] Field of Search ..... 92/68, 71, 92; 49/339, 49/340; 60/370

[56] References Cited

U.S. PATENT DOCUMENTS

| | | | |
|---|---|---|---|
| 2,940,572 | 6/1960 | Warman | 92/92 |
| 3,202,061 | 8/1965 | Johnston . | |
| 3,618,638 | 11/1971 | Varlott | 92/92 X |
| 3,853,143 | 12/1974 | De Depeleire . | |
| 3,865,373 | 2/1975 | Knight . | |
| 3,973,471 | 8/1976 | Hirmann | 92/92 X |
| 3,996,698 | 12/1976 | Rees et al. | 92/92 X |
| 4,426,805 | 1/1984 | Riead . | |
| 4,610,369 | 9/1986 | Mercier | 92/92 |
| 4,739,996 | 4/1988 | Vedder . | |
| 4,768,871 | 9/1988 | Mittelhauser et al. | 92/92 X |
| 4,876,946 | 10/1989 | Shishkin et al. | 92/72 X |
| 5,018,435 | 5/1991 | Kagi | 92/71 X |

FOREIGN PATENT DOCUMENTS

| | | |
|---|---|---|
| 101493 | 6/1937 | Australia . |
| 421030 | 2/1972 | Australia . |
| 445718 | 2/1974 | Australia . |
| 471691 | 4/1976 | Australia . |
| 482965 | 4/1977 | Australia . |
| 0223924 | 6/1987 | Fed. Rep. of Germany . |
| 2480425 | 10/1981 | France . |
| 2634278 | 1/1990 | France . |

*Primary Examiner*—Edward K. Look
*Assistant Examiner*—Hoang Nguyen
*Attorney, Agent, or Firm*—Stevens, Davis, Miller & Mosher

[57] ABSTRACT

A gas actuator (21) and a pop-up target (10) incorporating the gas actuator (21) are disclosed. The gas actuator (21) comprises support surfaces (24, 26), pivoting surfaces 5 (64,66) pivotably coupled upon the support surfaces (24, 26), respectively, and flexible and inflatable members (18, 20) disposed for pivoting the pivoting surfaces (64, 66) with respect to the support surfaces (24, 26) between a first and a second position. The members (18, 20) act over a relatively large area between the support surfaces (24, 26) and the pivoting surfaces (64, 66). The magnitude of the pivoting force produced by the members (18, 20) increases to a maximum and thereafter decreases as the pivoting surface (64) pivots upwards. An accumulator (104) allows for relatively low flow rates of as from a source of compressed as (102) and provides relatively high flow rates of compressed as to the members (18, 20).

32 Claims, 10 Drawing Sheets

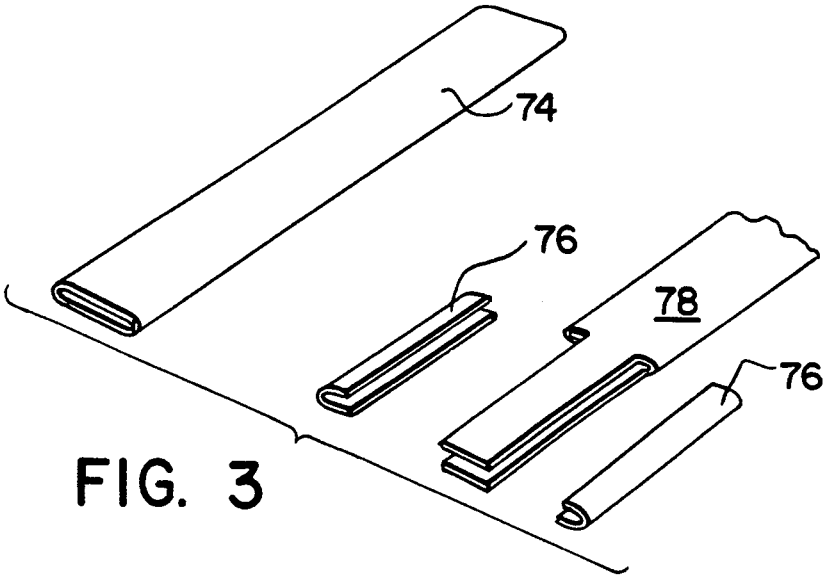
FIG. 3
FIG. 4
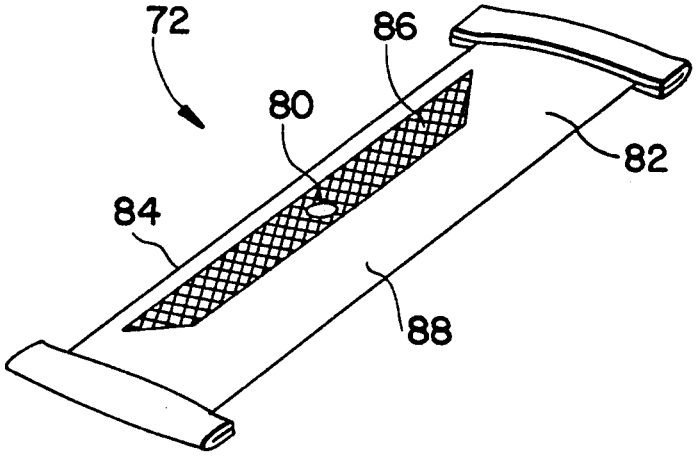

PIVOTING ACTUATOR AND A POP-UP TARGET INCORPORATING SAME

DESCRIPTION

The present invention relates to a pivoting actuator, particularly, although not exclusively, envisaged for use in pivoting a panel with respect to a surface or another panel The present invention more particularly relates to a pop-up target particularly, although not exclusively, envisaged for use in shooting practice.

FIELD OF THE INVENTION

Prior art pop-up targets rely upon actuators including geared electric motors, pneumatic rams and springs to pivot a target panel from a concealed position to a revealed position It is important that the actuator be capable of such pivoting in a relatively short period of time so as to provide an element of surprise when the target panel is revealed Typically, such a period of time is less than 0.5 seconds. Hence the actuators must provide sufficient power to pivot the target panel through approximately 90° in less than 0.5 seconds. Such speed of operation leads to disadvantages with prior art pop-up targets For example, electric motors must be made relatively large to provide the rapid actuation and therefore are relatively heavy and expensive. Also, pnuematic rams must be of a relatively large diameter and of relatively high pressure to achieve rapid actuation and also require a source of compressed air capable of relatively high flow rates. Spring actuators have the disadvantage that resetting of the target panel must be accomplished either manually or through use of an electric motor or the like.

For ease of transportation, positioning and concealing of the pop-up targets at a practice location it is desireable to have a relatively small base for the pop-up target. Where a remote source of electrical and/or pneumatic power is used it is preferable that any connecting pipe work and/or wiring, between the power source and the pop-up target be of a relatively small diameter or gauge. Also, the connecting pipe work or wiring (if any) should preferably be flexible so that it may easily be concealed when in use.

SUMMARY OF THE INVENTION

Therefore, it is an object of the present invention to provide a pivoting actuator capable of pivoting between two positions.

In accordance with one aspect of the present invention there is provided a gas actuator comprising a first member having a first surface;

a second member having a second surface, said first and second members pivotally coupled together to allow said second member to pivot with respect to said first member between a first and second position;

a flexible and inflatable member disposed between said first and second surfaces and adapted for exerting a force therebetween to pivot said second member from said first position to said second position; and, means for controlling the magnitude of said force in such a manner that the magnitude of said force increases to a maximum and thereafter decreases prior to said second member reaching said second position Also, it is an object of the present invention to provide a pop-up target capable of relatively rapid actuation while having a relatively compact actuator.

In accordance with one aspect of the present invention there is provided a gas actuator comprising a first member having a first and a second surface portion;

a second member having a third and a fourth surface portion, said first and second members pivotally coupled together to allow said second member to pivot with respect to said first member between a first position in which said first and third surface portions are substantially parallel and a second position in which said second and fourth surface portions are substantially parallel;

a first flexible and inflatable member disposed between said first and third surface portions, and adapted for exerting a force therebetween to pivot said second member to said second position;

a second flexible and inflatable member disposed between said second and fourth surface portions and adapted for exerting a force therebetween to pivot said second member to said first position; and, means for controlling the magnitude of said force exerted by said first flexible and inflatable member in such a manner that the magnitude of said force increases to a maximum and thereafter decreases prior to said second member reaching said second position The present invention will hereinafter be described with particular reference to pop-up targets being targets for shooting practice, although it is to be understood that it can be used in other situations requiring panels to be pivoted.

BRIEF DESCRIPTION OF THE DRAWINGS

Embodiments, being examples only, of the present invention will now be described with reference to the accompanying drawings, in which:

FIGS. 3 and 4 are perspective views showing construction of the gas actuators;

DETAILED DESCRIPTION OF PREFERRED EMBODIMENTS

Figure 1:
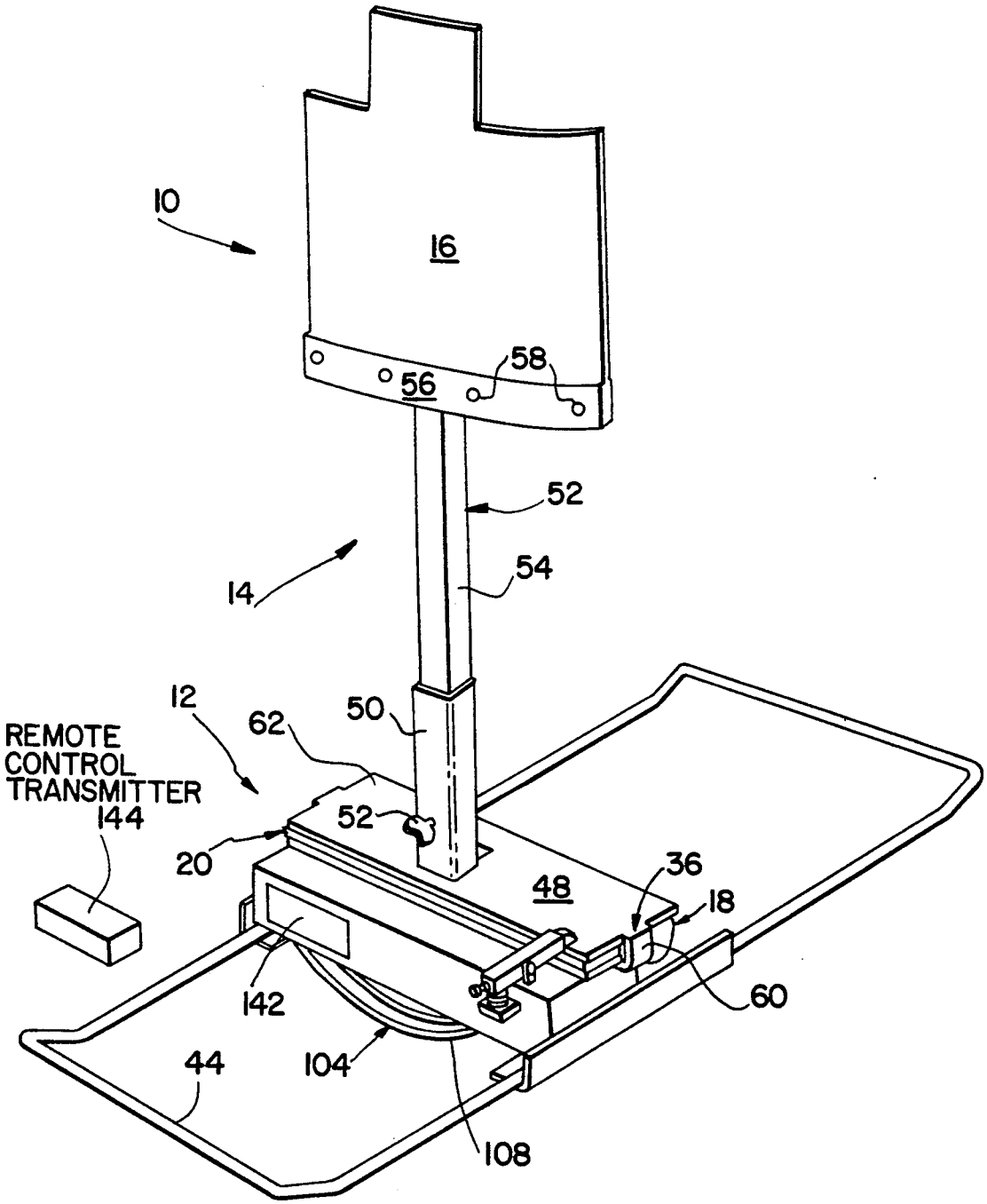
FIG. 1 is a perspective view, seen from above, of a pop-u target.

In FIG. 1 there s shown a pop-up target 10 comprising a base 12, a target carrier 14, a target panel 16 carried by the target carrier 14 and a first flexible and inflatable member 18 and a second flexible and inflatable member 20. The base 12 and the members 18 and 20 are comprised in a gas actuator 21 (see FIG. 2)

Figure 2:
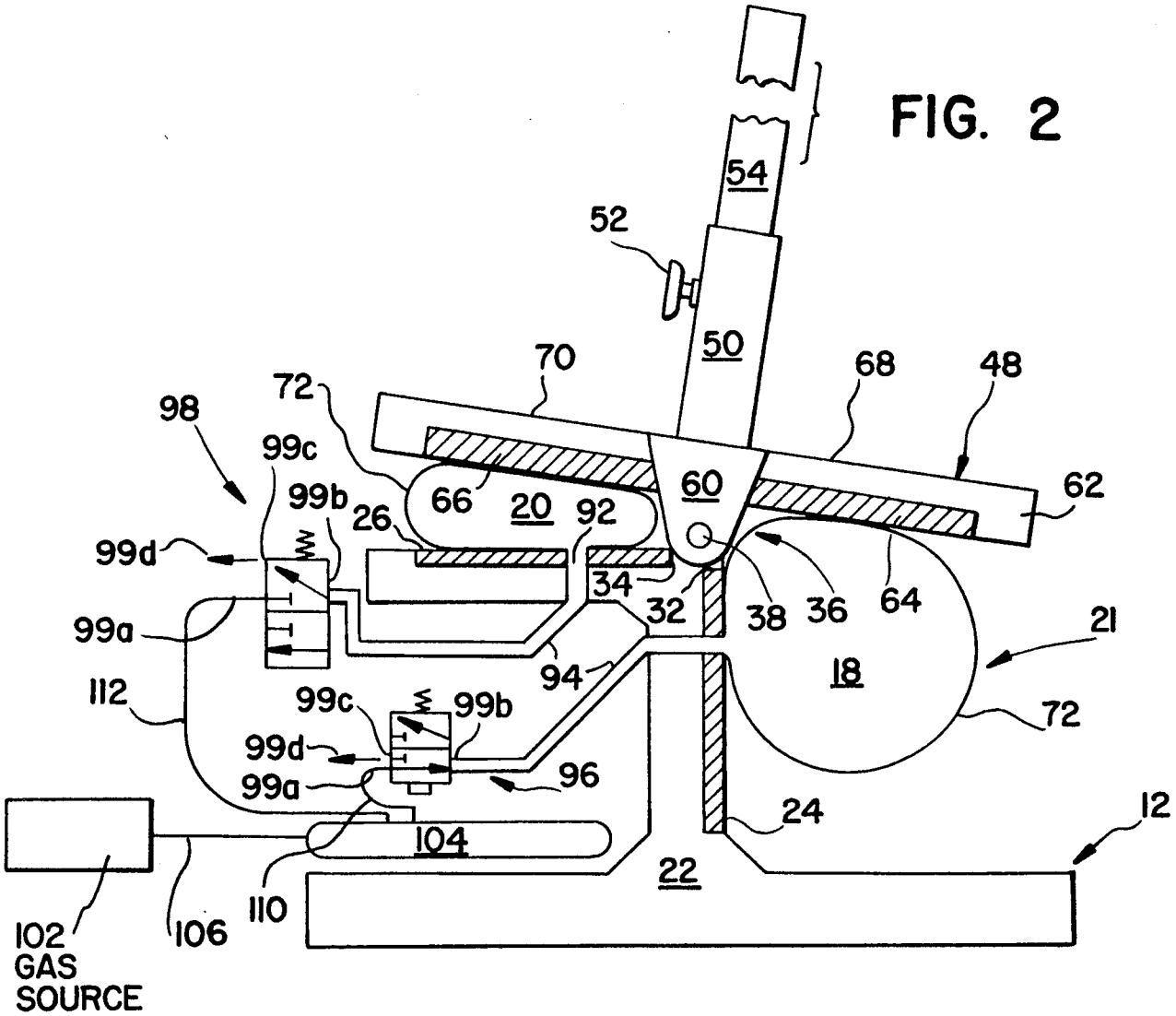
FIG. 2 is a schematic cross-sectional side view of a base, a target carrier and two flexible and inflatable members of the pop-up target of FIG. 1.

As shown in FIG. 2 the base 12 has a first member in the form of a frame 22 with first and second surface portions 24 and 26 respectively The surface portions 24 and 26 are disposed proximate to each other and have substantially parallel edges For example, an edge 32 of the working surface 24 terminates proximate and substantially parallel to an edge 34 of the other working surface 26. The first and second surface portions 24 and 26 are interposed by a pivot 36 of the base 12. The pivot 36 includes two axles 38 projecting from the frame 22 at opposite sides of the base 12.

In the present embodiment the surface portions 24 and 26 are disposed at right angles to each other and the axles 38 are centered at a corner (not shown) of the frame 22 formed between the surface portions 24 and 26.

Also shown in FIG. 1 the base 12 also typically has two removeable handles 42 and 44 conveniently in the form of two tubes 46 bent to form two open rectangles. The tubes 46 have their ends attached at or proximate the frame 22. The handles 42 and 44 are shaped for convenient carrying of the target 10, such as, by two people. Also, the handles 42 and 44 are designed to resist overturning of the pop-up target 10 during operation.

The pivot 36 allows pivoting of the target carrier 14 between a first position, herein referred to as a concealed position, wherein the target carrier 14 is disposed proximate and substantially parellel to the base 12, and a second position, herein referred to as a revealed position, wherein the target carrier is disposed substantially at right angles to the base 12. In the concealed position the target panel 16 is, when in use, intended not to be visible, such as, for example, by disposition substantially parallel to the ground. In the revealed position the target panel 16 is, when in use, intended to be visible, such as, for example, by disposition substantially at right angles to the ground The target carrier 14 also comprises a plate 48, an upright 50 conveniently disposed at right angles to the plate 48 and a "T" piece 51. The upright 50 is typically formed of rectangular section tube and has a locking bolt 52 threadedly engaged in one side. The "T" piece 51 has a leg 54 shaped and dimensioned to telescopically fit into the upright 50 for locking therein with the bolt 52. The "T" piece 51 also has a fixing bar 56 located atop the leg 54. The bar 56 has a plurality of fasteners 58 for removably attaching the target panel 16 to the target carrier 14.

Alternatively, the upright 50 may be a "C" section channel and the leg 54 is clampable into the channel.

The target panel 16 is preferably substantially planar and defines three dimensional surfaces at its front and/or its rear planar faces. In the present embodiment the target panel 16 is smoothly curved. The bar 56 is preferably correspondingly curved. The curvature is about an axis parallel to the leg 54 and is typically directed so as to appear convex when viewed from the end of the pop-up target 10 having the handle 44. The target panel 16 is conveniently formed of cardboard or plastic. It has been discovered that the target panel 16 is prone to bending at the bar 56 unless the target panel 16 is curved or otherwise not flat. The bending was found to occur due to the wind resistance of the target panel 16 and the rapid speed of transition between the concealed and revealed positions.

As shown in FIG. 1 and 2 each pivot 36 also has an apertured tab 60 disposed on a second member in the form of plate 48 to receive a respective one of the axles 38 located on the frame 22. The tabs 60 are located intermediate length of sides 62 of the plate 48.

Plate 48 includes third and fourth surface portions 64 and 66 respectively. The third surface portion 64 is located to correspond with the first surface portion 24 and the second surface portion 26 is located to correspond with the fourth surface portion 66 In the present embodiment the pivot 36 is allowed pivotal motion by the plate 48 through an angle of about 90°. The pivotal motion is limited in one direction when the surface portions 24 and 64 meet or substantially meet, and in the other direction when the surface portions 26 and 66 meet or substantially meet.

The surface portions 64 and 66 each have a reinforcing plate 68 and 70, respectively. The reinforcing plates 68 and 70 strengthen the surface portions 64 and 66 and avoid deformation and breaking thereof. Typically, in the present embodiment, the surface portions 64 and 66 are a single piece of metal material fixed to or into the plate 48.

The first and second flexible and inflatable members 18 and 20 are each typically in the form of a gas bag 72. First and second gas bags 72 are fixed between each pair of surface portions 24 and 64, and 26 and 66 respectively. Preferably, the gas bags 72 have a naturally flat shape when deflated so as to allow for deflating substantially without creasing and to avoid sliding movement of the gas bags 72 with respect to the surface portions 24 and 64, or 26 and 66 during inflation and deflation.

Figure 11:
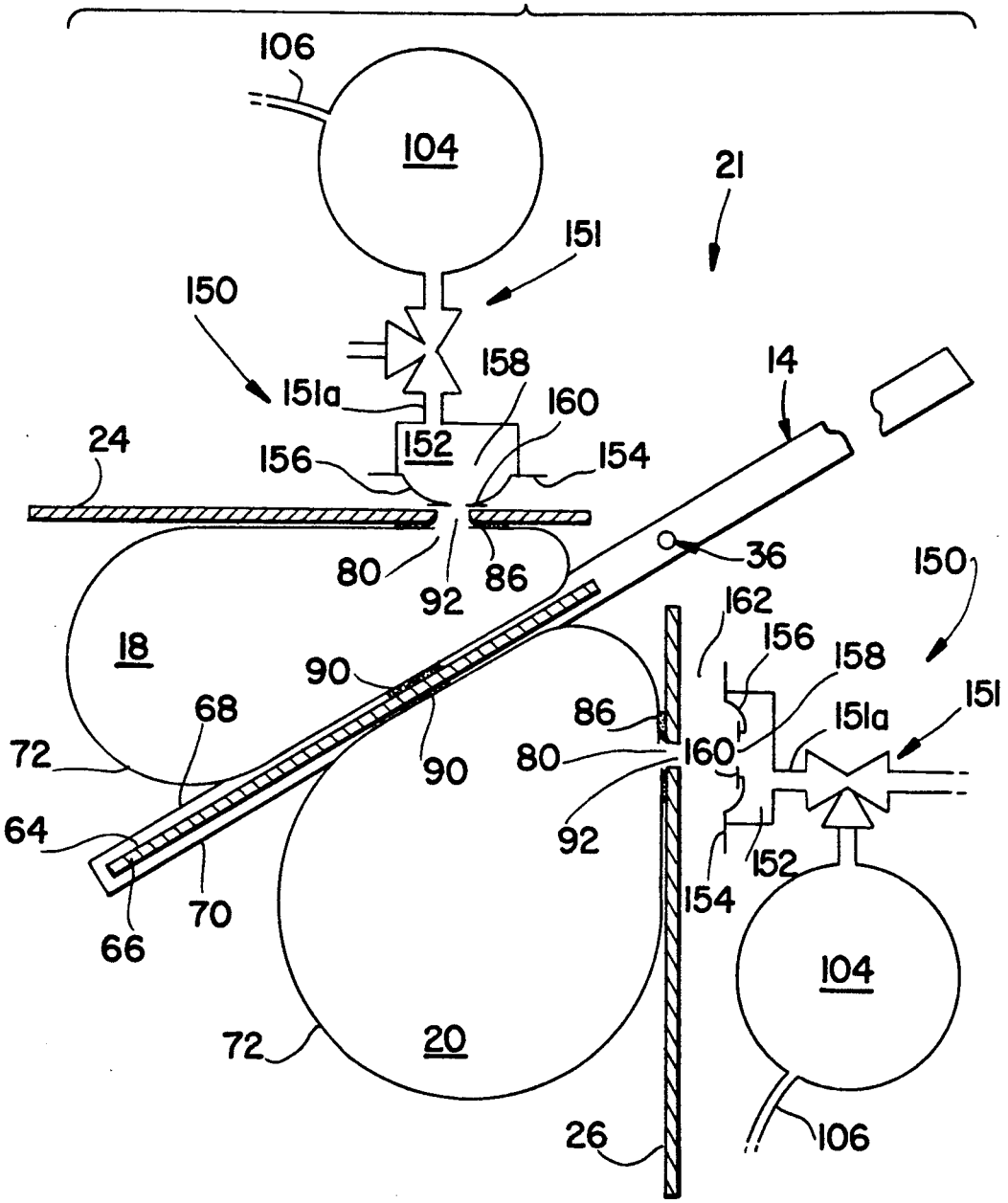
FIG. 11 is a part schematic side view similar to FIG. 2 but showing another embodiment of a valve for operation of the gas actuators; and, FIG. 12 is a perspective view, seen from above, of a gas actuator in accordance with another embodiment of the present invention, shown coupled to a door hinged into a wall.

As shown in FIG. 3 and 4 the gas bags 72 are typically formed from a length of flexible tube 74, preferably of the type which lays flat when not filled with fluid, such as, for example, fabric covered fire hose with rubber lining. The open ends of the tube 74 are sealed with cut-out sections 76 from a further length of tube 78. The cut-out sections 76 are conveniently fixed to the open ends of the tube 74 by gluing. The gas bag 72 also has a hole 80 made in one side 82 of it and closer to an edge 84 of the gas bag 72 than other edges thereof An area 86 of the gas bag 72 of FIG. 4 is shown hatched. The area 86 represents an area of glued contact between the side 82 of the gas bag 72 and the working surfaces 24 or 26. The other side 88 of the gas bag has a similar area 90 (as shown in FIG. 11) which is glued to the surface portions 64 and 66. In the present embodiment the first member 18 is glued at the areas 86 and 90 between the working surfaces 24 and 64 respectively, and the second member 20 is glued at the areas 86 and 90 between the working surfaces 26 and 66, particularly as shown in FIG. 11.

It is envisaged that the areas 86 and 90 could be fixed by other means to the surface portions 24, 26, 64 and 66, such as, for example, with a metal strip located inside the gas bag 72 and having bolts protruding through the sides 82 and 88 for fixing with threadedly engaging nuts to the surface portions 24, 26, 64 and 66.

As shown in FIG. 2 the surface portions 24 and 26 each have a hole 92 overlying the hole 80 in the corresponding gas bag **72*a* and 72*b* respectively (see for example FIG. 11**).

A tube 94 is coupled into each of the holes 92. The gas actuator 21 also comprises two valves 96 and 98, respectively. The tubes 94 connect the members 18 and 20 to the valves 96 and 98 respectively. Preferably, the valves 96 and 98 are three port two way solenoid operated valves. The valves 96 and 98 typically include an inlet 99*a*, an outlet 99*b*, a restrictor 99*c* and another outlet 99*d*. The valves 96 and 98 are operable in an inlet condition in which the inlet 99*a* is into the gas bag 72, and an exhaust condition in which the outlet 99*b* is connected to the outlet 99*d* via the restrictor 99*c*, to allow exhaust of compressed gas from the gas bag 72 to the atmosphere.

The gas actuator 21 also comprises a gas supply 100 having a source of compressed gas 102. Typically, the gas is air or carbon dioxide or the like. The source of compressed gas 102 may be a gas compressor or a cylinder of compressed gas. The source of compressed gas 100 may be located either proximate or remote from the base 12 dependent upon the size of the source 100. For example, a small compressor or cylinder (such as, for example, a soda syphon sparklet) may be located proximate or within the base 12 whereas a large compressor or a large cylinder (such as, for example, a SCUBA tank) is preferably located remote from the base.

In the present embodiment the gas supply 100 has an accumulator 104 and a tube 106 connecting the gas source 102 to the accumulator 104. Typically, the accumulator 104 comprises a tube 108 of high pressure hose, such as, for example, compressed air hose (see FIG. 1). The tube 108 is conveniently coiled and located within the base 12. Such tube 108 is advantageous since in the event of its rupture, such as, by a bullet or shrapnel, flying pieces of the tube 108 are less likely to cause damage to person or property than metal tubing or a metal canister. Typically, the tube 108 is encased in a light gauge metal housing or cover (not shown) attached to the base 12 for confining any fragmentation of the tube 108.

The gas supply 100 also has two tubes 110 and 112 connecting the accumulator 104 to the inlets 99*a* of the valves 96 and 98. The two valves 96 and 98 are connected so that both valves 96 and 98 are deactivated when the target carrier 14 has changed positions. Hence, supply of gas and electrical power to the solenoid valves 96 and 98 is only required during pivoting operations. Also, since the valves 96 and 98 are three port two way valves they vent the gas bags 72 to atmosphere once the valves 96 or 98 are deactivated. This allows for more rapid pivoting between the two positions of the target carrier 14.

Figure 7:
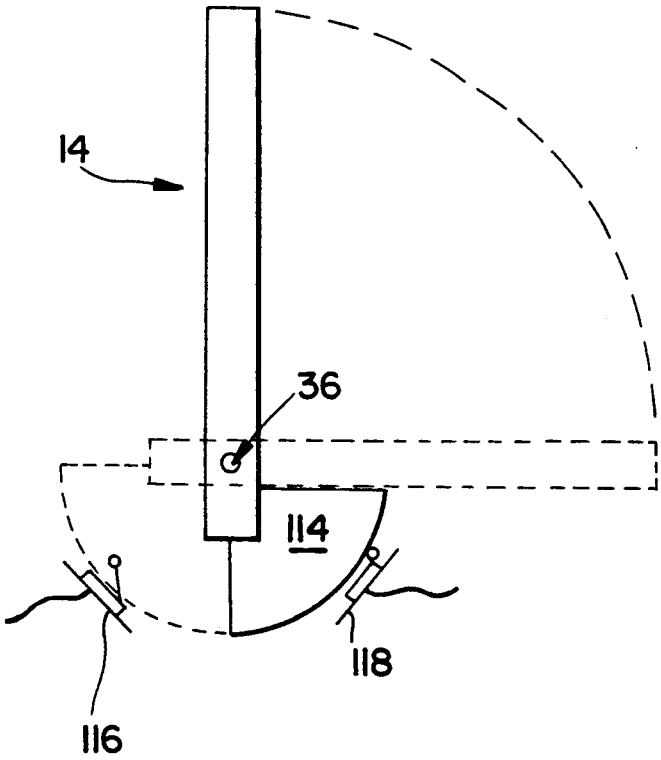
FIG. 7 is a schematic side view of a valve timer of the pop-up target of FIG. 1.

As shown in FIG. 7 the target carrier 14 may also have a cam plate 114. The cam plate 114 is positioned for pivoting with the target carrier 14, such as, for example, by fixing to the plate 48. Two microswitches 116 and 118 are positioned in the base 12 for actuation by pivoting of the target carrier 14. The cam plate 114 and the microswitches 116 and 118 form a valve timing means of the present invention The cam plate 114 is shaped so that when the target carrier 14 is in the concealed position the microswitch 116 conducts to provide a path for electrical power to the solenoid of the valve 96. The cam plate 114 is also shaped to maintain conductance of the microswitch 116 during a proportion of the pivoting of the target carrier 14. Typically, the proportion is between 5% and 50%, such as, for example between 33% to 44%. The cam plate 114 is similarly shaped to activate the microswitch 118 for a proportion between 5% and 50%, such as, for example between 11% and 17%.

It has been discovered that due to the nature of the gas actuators 18 and 20 it is not necessary to provide compressed gas for the entire pivotal motion of the target carrier 14. This is because the greatest force in pivoting has been found to be required when pivoting commences and that the required force decreases with increase in the angle of pivot. In the present embodiment less force is required to pivot the target carrier back to the concealed position (i.e. substantially horizontal) due to the assisting force of gravity—hence the cam plate 114 may be shaped to contact the microswitch 118 for less time than the micro switch 116.

The accumulator 104 preferably has sufficient compressed gas to effect one complete cycle of pivoting the target carrier 14 from the concealed position, to the revealed position and back again. The accumulator 104 allows for a relatively high flow rate of gas to the valves 96 and 98 whilst receiving compressed gas at a relatively low flow rate from the gas source 102. Hence, the tube 106 can be relatively small in diameter to allow convenient routing of the tube 106 from the gas source 102, when remotely located, and the accumulator 104.

It is envisaged that one accumulator 104 could be provided for each gas actuator 18 and 20.

It is envisaged that the accumulator 104 could be omitted and relatively high flow rate tube provided directly from the gas source 102 to the valves 96 and 98. In such a case it is preferred that the gas source 102 be locatable within the base 12.

Figure 5:
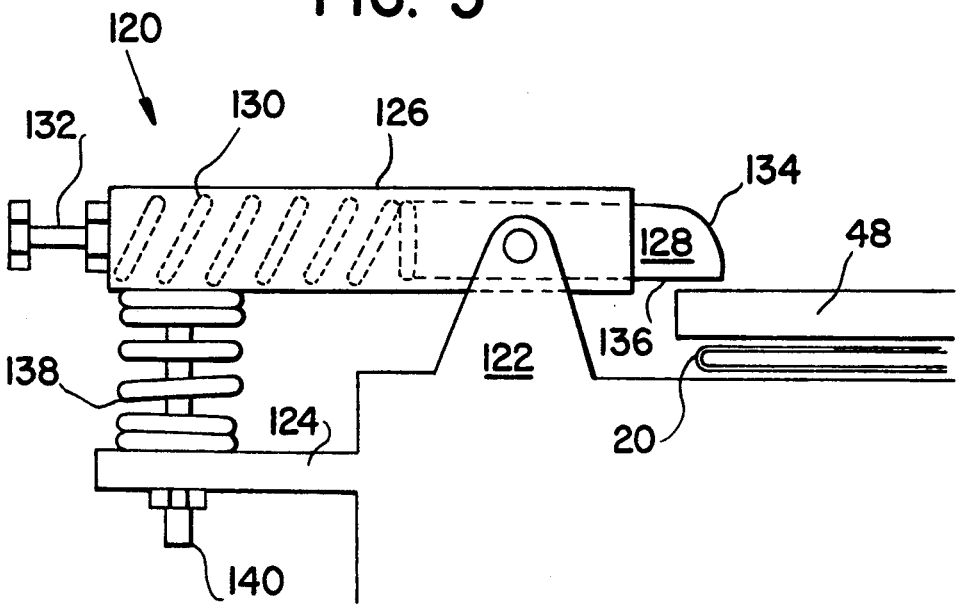
FIG. 5 is a side view of a latch of the pop-up target of FIG. 1, shown to an enlarged scale.

The base 12 also has a latch 120 shown in FIG. 5. The latch 120 is attached to two brackets 122 and 124 projecting from the base 12. The latch 120 comprises a hollow arm 126 slidably carrying a plunger 128 against the force of a relatively light stiffness spring 130. The arm 126 is pivotally attached to the bracket 122. A bolt 132 is provided to adjust the travel of the plunger 128 against the spring 130. The plunger 128 is shaped like a plunger in a conventional door latch. A curved side 134 of the plunger 128 is disposed upwardly and a flat side 136 is disposed downwardly toward the base 12. The curved side 134 is shaped to allow the plate 48 to force the plunger 128 into the arm 126 against the force of the spring 130 as the target carrier 14 pivots to the revealed position. Once at the revealed position the flat side 136 inhibits pivoting of the plate 48 toward the concealed position.

The latch 120 also comprises a relatively heavy stiffness spring 138 maintained between the bracket 124 and the arm 125 by a bolt 140. The spring 138 is disposed to urge the flat side 136 of the plunger 128 toward the base 12. The stiffness of the spring 138 is chosen so that the force of the gas actuator 20 is sufficient to force the plate 48 against the flat side 136 of the plunger 128 to compress the spring 138 sufficiently so that the latch 120 pivots to allow the plate 48 passed the plunger 128. A valve spring for an inlet valve in a motor vehicle engine can be used as the spring 138.

It is envisaged that the second member 20 could be omitted and only the first member 18 used for pivoting the target carrier 14. In such a case manual or gravity resetting of the target carrier 14 to the concealed position is required and the spring 138 of the latch is not required It is envisaged that the base 12 could be secured to a surface for use, such as, for example, the ground, a floor, a wall, a ceiling or the like.

It is envisaged that other shaped gas bags 72 could be used such as, for example, a folded rectangular shaped bag.

It is envisaged that a further latch could be provided to releasably lock the target carrier 14 in the concealed position.

As shown in FIG. 1 the pop-up target 10 also has a remote control receiver 142 located in the base 12. The receiver 142 is electrically connected to actuate the solenoids of the valves 96 and 98 upon receiving a valid controlling signal from a remote control transmitter 144. The transmitter 144 and receiver 142 may operate at a convenient frequency, such as, for example, radio frequency. The signals from the transmitter 144 may be coded to carry information and may be encrypted to avoid duplication by unauthorised persons. The transmitter 144 and receiver 142 allow for remote revealing and concealing of the target panel 16.

It is envisaged that activation of the members 18 and 20 could be via a remotely located switch electrically wired to the solenoids of the valves 96 and 98.

It is also envisaged that the activation of the pop-up target 10 could be controlled by a timer, or a preprogrammed sequence of timings and/or made subject to tripping of position sensors located remote from the target 10.

Figure 12:
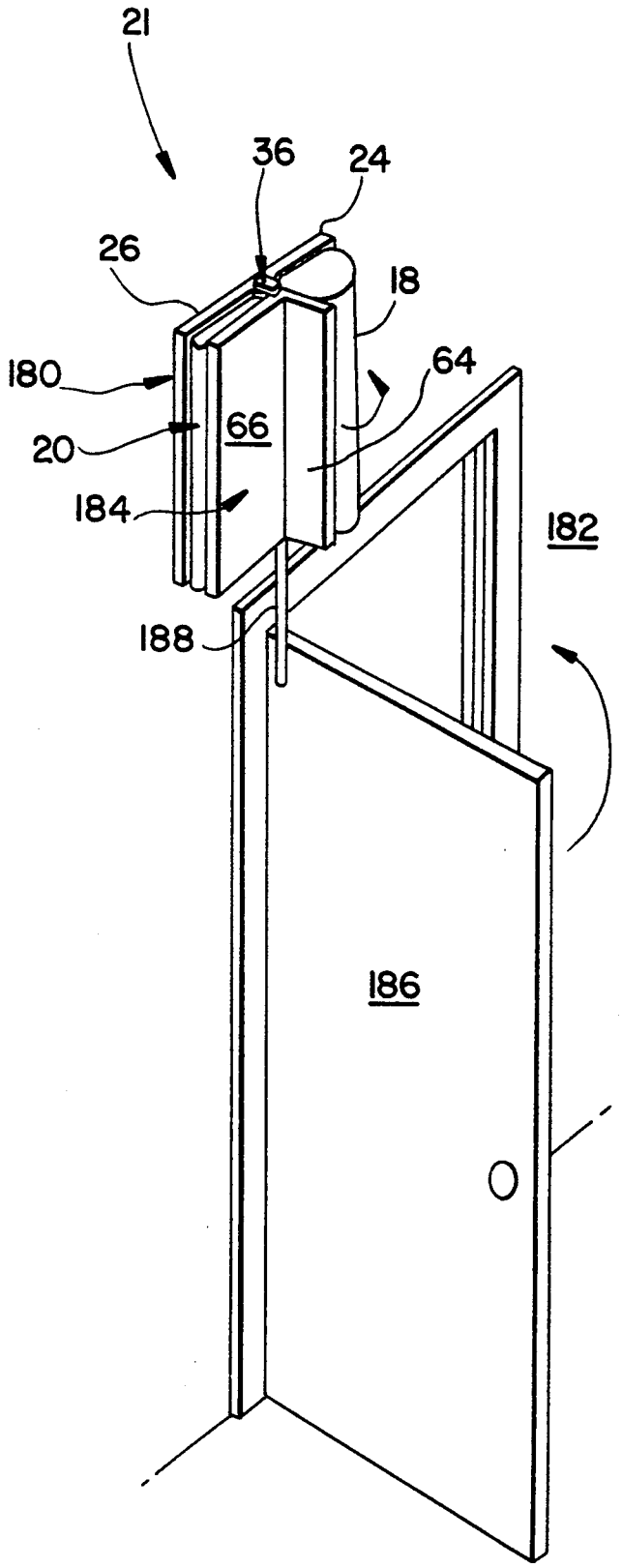

As shown in FIG. 12 the gas actuator 21 may be applied to pivot panels other than target panels 16 with respect to a surface. In FIG. 12 the gas actuator 21 is shown having the surface portions 24 and 26 (which here constitute a support surface 180) fixed to a wall 182, such as, for example, by bolting. The surface portions 64 and 66 (which constitute a pivoting surface 184) are substantially perpendicular to each other and are coupled to a door 186 by an arm 188. Although the surface portions 64 and 66 could be at any angle through which the door 186 is desired to be pivoted. The arm 188 is typically bolted to the door 186 so that pivoting of the pivoting surface 184 produces corresponding pivoting of the door 186.

Typically, the gas actuator 21 may be arranged so as to open and close the door 186 into the wall 182.

In use, the pop-up target 10 is taken to a field site for use in target practice. Such a site may be located in the jungle, in the desert, in a building or on a practice firing range or the like. Typically, the base 12 is free standing but may be secured to the site such as with stakes or by bolting or the like. The gas source 102 (if remote) is connected via the tube 106 to the accumulator 104 to precharge the accumulator 104.

Typically, the accumulator 104 is made of air hose 10 mm in diameter and about 5 meter long giving a volume of about 0.4 liters (such as 0.38 liters) and is precharged to about 800 kPa. Typically, the gas bags 72 are about 50 mm internal diameter when inflated and about 0.45 m long—giving a volume of about 0.9 liters (such as 0.88 liters). It has been found that the gas bags 72 can pivot the target carrier 14 and target panel 16 (being 1.8 meters high, 0.45 meters wide and weighing 5 kg) between the two positions in less than 0.4 seconds and without the need for recharging the accumulator 104.

Considering the target carrier 14 to be in the concealed position the operation of the pop-up target 10 is as follows.

To actuate the pop-up target 10 the transmitter 144 is operated to produce a signal for initiating pivotal movement either from the concealed position to the revealed position or for initiating the reverse movement Such as signal from the transmitter 144 thus activates the receiver 142. The receiver 142 issues an activating signal to a corresponding one of the microswitches 116 and 118. In the concealed position the cam plate 114 is in contact with the lever of the microswitch 116 and causes the microswitch 116 to conduct and the microswitch 118 not to conduct. The conductance of the microswitch 116 causes electrical power to be supplied to the solenoid of the valve 96 to activate same The valve 96, thus activated, connects the inlet **99*a* with the outlet 99*b* to allow compressed gas from the accumulator 104 to pass through the tube 110, through the valve 96, through the tube 94, through the holes 92 and 80 and into the first flexible and inflatable member 18. The gas causes the first member 18 to commence inflating which causes the first and third surface portions 24 and 64 to pivot apart about the pivot 36. Simultanously, the second and fourth surface portions 26 and 66 pivot toward each other thus compressing the second member 20 to expell air via the outlet 99*d* via the restictor 99*c*. The restrictor 99*c* causes a pressure build up within the second flexible and inflatable member 20 so as to cushion the pivotal motion of the target carrier 14 to the revealed position As the target carrier 14 pivots the cam plate 114 slides along the lever of the microswitch 116 and before contact therebetween is lost electical power is maintained to the solenoid of the valve 96. During this time the gas pressure in the first member 18 builds up to about 300 kPa. Once said contact is lost the solenoid is de-activated and the valve 96 switches to connect the outlets 99*b* to the outlet 99*d* by the restrictor 99*c*. Thus, gas commences to exhaust from the first member 18 once the solenoid is de-activated, for example, after about 30° of pivot of the target carrier 14. However, the restrictor 99*c* is set to control the exhaust of the gas so that the pressure within the first member 18 does not fall to atmospheric pressure until approximately at or after the moment that the target carrier 14 reaches the limit of its pivotal travel. The pressure developed in the first member 18 and the momentum of the target carrier 14 and the target panel 16 developed prior to the de-activation of the solenoid has been found sufficient to continue the pivotal motion of the target carrier 14 and the target panel 16** to the revealed position, even against a strong head wind.

It is to be noted that as the target carrier 14 reaches the revealed position the pressure of the gas in the first member 18 approaches atmospheric, the second and fourth surface portions 26 and 66 expell the remainder of the gas from the second member 20 and the momentum of the target carrier 14 and the target panel 16 decreases All these factors tend to lead to a cushioning of the completion of the pivotal travel of the target carrier 14.

As the end of the pivotal travel is reached the plate 48 stikes the curved side 134 of the plunger 128 and forces the plunger 128 into the hollow arm 126 against the force of the spring 130. Once the plate 48 travels passed the plunger 128, the plunger 128 propels back out of the hollow arm 126 and the flat side 136 locates above the plate 48 to inhibit the target carrier 14 bouncing back toward the concealed position The same process applies to resetting the target carrier 14 to the concealed position except that the second member 20, the working surface portions 26 and 66 and the other valve 98 and the microswitch 118 are involved instead of those previously discussed.

Figure 8:
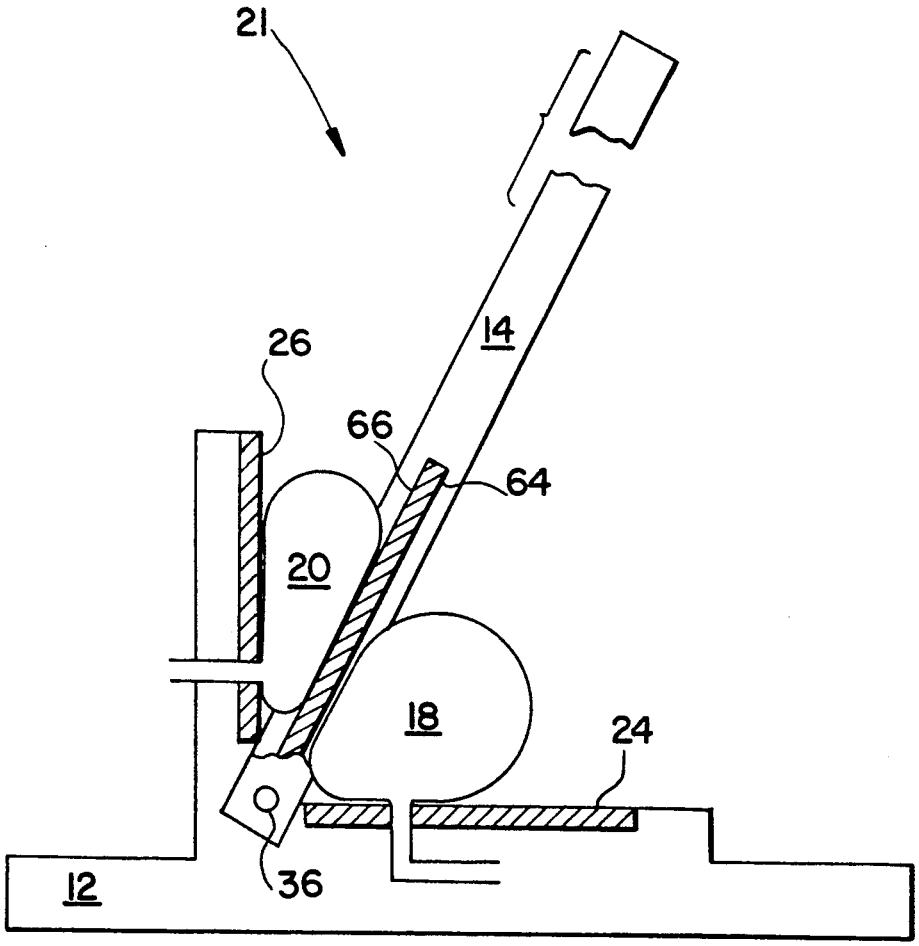
FIGS. 8 to 10 are schematic cross-sectional side views similar to that of FIG. 2 but showing other embodiments of the arrangement of the flexible and inflatable members, the base and the target carrier.
Figure 9:
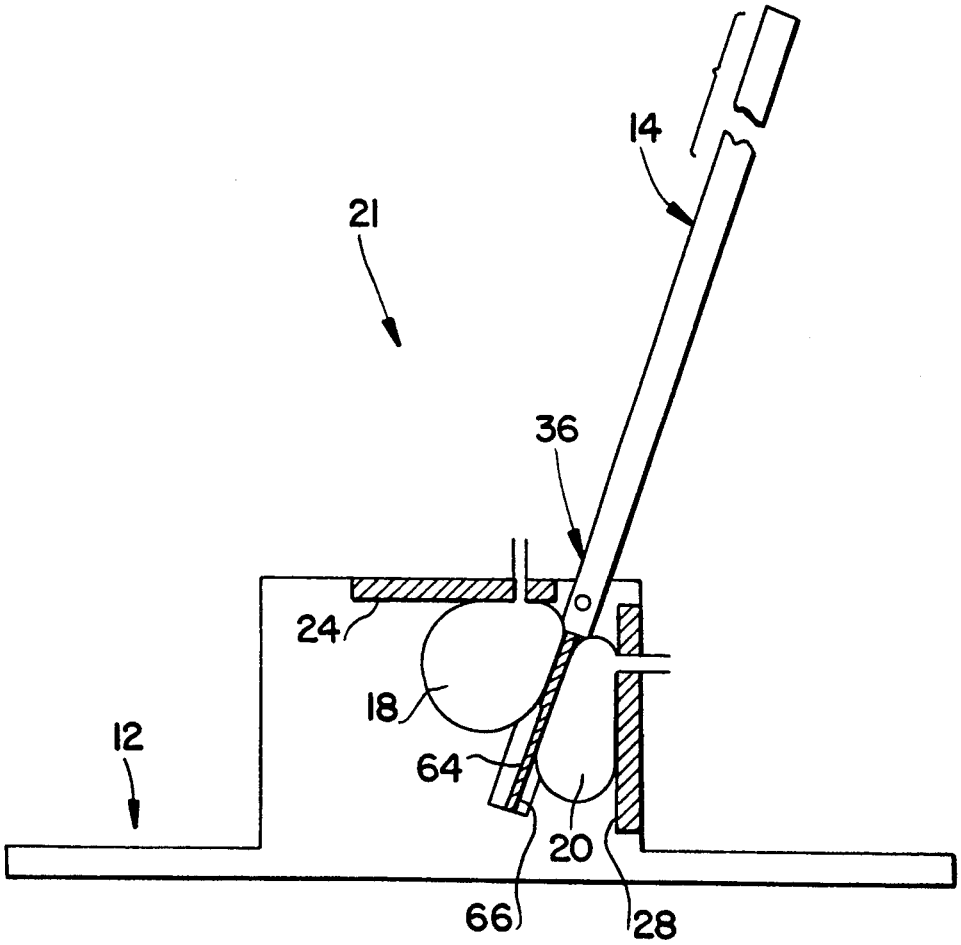
Figure 10:
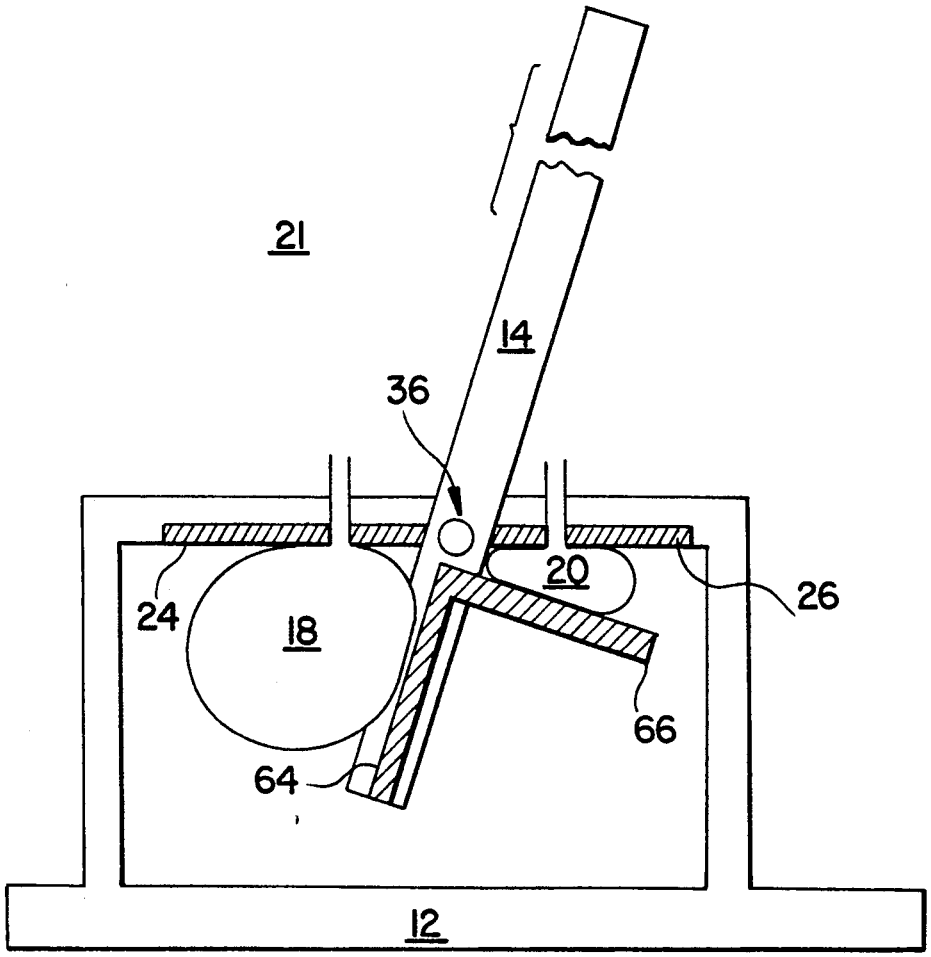

In FIGS. 8 to 10 there are shown other embodiments of the surface portions 24, 26, 64 and 66, and including other arrangements of the pivot 36, the target carrier 14 and the members 18 and 20. In FIGS. 8 and 9, the surface portions 64 and 66 are combine. In FIG. 10 the fourth surface portion 66 is disposed at right angles to the third surface portion 64.

Figure 6:
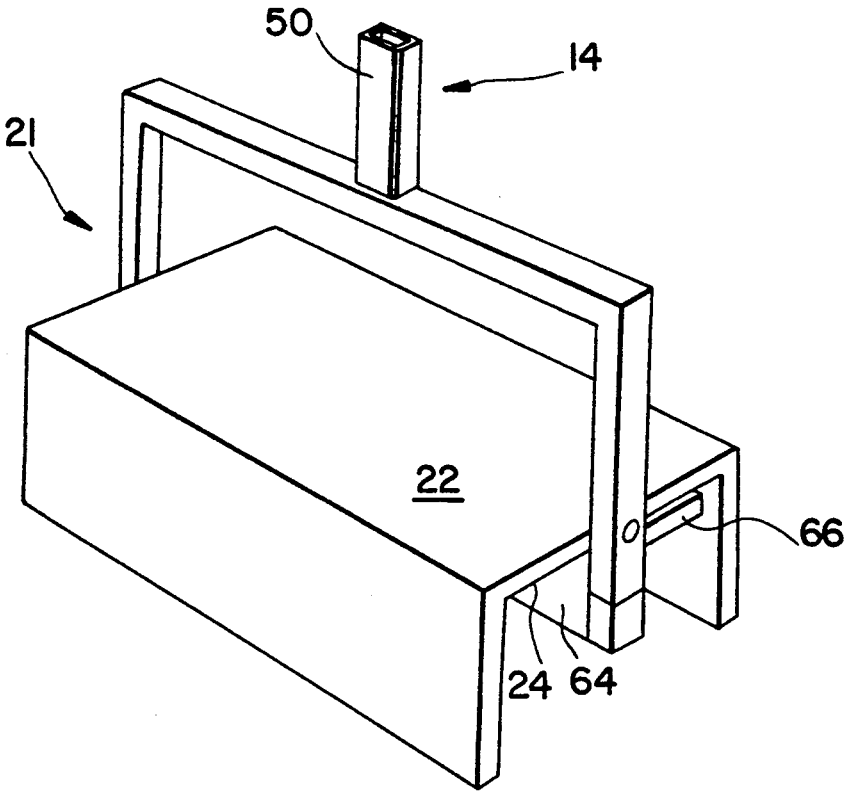
FIG. 6 is a perspective view, seen from above, of one embodiment of the target carrier of the pop-up target of FIG. 1.

In FIG. 6 there is shown an attachment for the target carrier 14 to the pivot 36 for the embodiment of FIG. 10.

In FIG. 11 there is shown a further embodiment similar to that of FIG. 9 but incorporating a different form of two way three port valve 150. The valves 150 each comprise a two way two port valve 151 having an outlet 151*a* connected to a chamber 152 having a side 154 including a flexible diaphragm 156. The diaphragm 156 has a central hole 158 about which a sealing ring 160 is located. The hole 158 is preferably smaller than the hole 92.

In use, the solenoid of the valve 151 controls supply of the compressed gas to the chamber 152. Upon such supply the chamber 152 fills with gas. The hole 158 produces a restriction which causes the diaphram 156 to distend Upon filling of the chamber 152 with gas the sealing ring 160 seats about the hole 92 thus allowing inflation of the gas bag 72*a*.

When the solenoid of the valve 151 is de-activated supply of gas is prevented and the diaphragm 156 retracts to its normal position Such retraction produces a relative large apperture 162 through which gas may exhaust from the gas bag 72 (for example, as shown for the gas bag 72*b*) via the holes 80 and 92. The exhausting gas acts to keep the diaphragm 156 clear of the hole 92.

It can be seen from the above that the pop-up target 10 of the present invention has advantages over the prior art in its use of the flexible and inflatable members 18 and 20 to produce a large and rapidly acting force for pivoting the target carrier 14. Also, the force decreases with pivoting so as to cushion the end of the travel of the target carrier 14. Further, the double acting latch 120 allows locking in the revealed position and allows for reversal of the target carrier 14 to the concealed position without the need for manual resetting. Still further, the control of the open times of the valves 96 and 98 by the cam plate 114 and the microswitches 116 and 118 conserves the gas, assists in cushioning the end travel of the target carrier 14 and inhibits re-actuation of the target carrier 14 during transition between the two positions. Still further, the accumulator 104 allows for a relatively large flow rate of gas to the gas bags 72, whilst being itself supplied at a relatively low flow rate. Thus, a miniture pump or small gas cylinder may be used to operate the members 18 and 20.

The advantages of the pop-up target 10 generally flow from the nature of the flexible and inflatable members 18 and 20 used. The flexible and inflatable members 18 and 20 contact a relatively large area between the surface portions 24, 26, 64 and 66 at the beginning of the pivotal motion when a large force is required Consequently, for a given pressure of gas within the members 18 and 20 a greater force is produced than for a conventional pneumatic ram of comparable diameter to the gas bags 72 and operating at the same pressure. Alternatively, the said conventional pneumatic ram must operate at higher pressure to cause actuation at the same speed as the members 18 and 20. The higher pressure necessitates larger flow rates of air in the pneumatic ram which is undesirable since it requires larger diameter tubing and higher capacity air pumps.

The gas actuator 21 of the present invention also embodies these advantages and may be used to control the pivot of panels, such as, for example, doors and windows. The speed of pivoting can be controlled by the restrictors 99*c*.

Typically, the target panel 16 includes a "hit" detector for alerting the occurrance of a projectile, such as a bullet, striking it. It is envisaged that means be provided to receive a signal initiated by the "hit" detector for reverting the target carrier 14 to the concealed position.

It is envisaged that a plurality of small gas cylinders, such as, for example, soda syphon cylinders, could be progressively loaded and actuated in the gas supply 100 of the present invention.

Modifications and variations such as would be apparent to a skilled addressee are deemed within the scope of the present invention. For example, the valve open angle of the valves 96 and 98 could be controlled by other forms of valve timers, such as, for example, optically or magnetically actuated timers or counters or the like. Also, the support surface 180 of the gas actuator 21 could be recessed into the wall 182.

I claim:

1. A gas actuator comprising:

a first member having a first surface;

a second member having a second surface, said first and second members being pivotally coupled together to allow said second member to pivot with respect to said first member between a first and second position;

a flexible and inflatable member disposed between said first and second surfaces and adapted for exerting a force therebetween to pivot said second member from said first position to said second position; and, means for controlling the magnitude of said force in such a manner that the magnitude of said force increases to a maximum and thereafter decreases prior to said second member reaching said second position, said means for controlling including a valve communicating between a supply of compressed gas and said flexible and inflatable member, and valve timing means for opening said valve to allow communication between said supply of compressed gas and said flexible and inflatable member for an initial period of time to allow inflation of said flexible and inflatable member to cause pivoting of said second member and thereafter closing said valve to cut-off said supply of compressed gas to said flexible and inflatable member, thereby controlling the magnitude of said force.

2. A gas actuator according to claim 1, wherein said valve timing means includes switching means for activating said valve and cam means connected to said second member for operating said switching means, wherein, said cam is profiled to operate said switching means for a portion of the pivoting of said second member.

3. A gas actuator according to claim 2, wherein the portion of the pivoting is between an initial 5% and 50% of the distance of pivoting from said first position to said second position.

4. A gas actuator according to claim further comprising an accumulator for suppling compressed gas to said flexible and inflatable member, wherein, in use, said accumulator receives compressed gas at a relatively low flow rate and supplies the compressed gas to the flexible and inflatable member at a relatively high flow rate.

5. A gas actuator according to claim 4, wherein said accumulator is a tube located proximate said flexible and inflatable member.

6. A gas actuator according to claim 1, further comprising a second flexible and inflatable member, said second flexible and inflatable member disposed for pivoting said second member from said second position toward said first position.

7. A gas actuator according to claim 1, further comprising latching means for releasably locking said second member in said second position.

8. A gas actuator according to claim 6, further comprising latching means for releasably locking said second member in said second position, said latching means including a first element for capturing said second member when in said second position, and a second element for releasing said second member for pivoting back toward said first position wherein, in use, the releasing by said second element is caused by inflation of said second flexible and inflatable member.

9. A gas actuator according claim 1, further comprising a source of compressed gas chosen from a group consisting of:

a gas compressor located remotely from said first member;

a gas compressor located within said first member;

a cylinder of compressed gas located remotely from said first member; and, a cylinder of compressed gas located within said first member.

10. A gas actuator according to claim 9, in which said source of compressed gas contains sufficient compressed gas for activating said flexible and inflatable member for pivoting said second member between said first and second positions once or twice.

11. A gas actuator according to claim 10, further comprising means for sequentially coupling respective ones of a plurality of said cylinders of compressed gas to said flexible and inflatable member.

12. A gas actuator according to claim 1, wherein said flexible and inflatable member has a substantially flat shape when deflated and a substantially circular shape in cross-section when inflated, and said flexible and inflatable member is located between, and fixed tangentially to, said first and second surfaces.

13. A gas actuator according to claim 12, wherein said first and second members are coupled by a pivot and said flexible and inflatable member is located proximate said pivot.

14. A gas actuator according to claim 1 further comprising a target connected to said second member whereby when said second member is in said first position, said target is concealed and when said second member is in said second position, said target is revealed.

15. A gas actuator comprising:

a first member having a first and a second surface portion;

a second member having a third and a fourth surface portion, said first and second members being pivotally coupled together to allow said second member to pivot with respect to said first member between a first position in which said first and third surface portions are substantially parallel and a second position in which said second and fourth surface portions are substantially parallel;

a first flexible and inflatable member disposed between said first and third surface portions, and adapted for exerting a force between to pivot said second member to said second position;

a second flexible and inflatable member disposed between said second and fourth surface portions and adapted for exerting a force therebetween to pivot said second member to said first position; and means for controlling the magnitude of said force exerted by said first flexible and inflatable member in such a manner that the magnitude of said force increases to a maximum and thereafter decreases prior to said second member reaching said second position, said means for controlling including a valve communicating between a supply of compressed gas and said first flexible and inflatable member, and valve timing means for opening said valve to allow communication between said supply of compressed gas and said first flexible and inflatable member for an initial period of time to allow inflation of said flexible and inflatable member to cause pivoting of said second member and thereafter closing said valve to cut-off said supply of compressed gas to said first flexible and inflatable member, thereby controlling the magnitude of said force.

16. A gas actuator according to claim 15, wherein said valve timing means includes switching means for activating said valve and cam means connected to said second member for operating said switching means, wherein, said cam is profiled to operate said switching means for a proportion of the pivoting of said second member.

17. A gas actuator according to claim 16, wherein the proportion of the pivoting is between an initial 5% and 50% of the distance of pivoting from said first position to said second position.

18. A gas actuator according to claim 15, further comprising an accumulator for supplying compressed gas to said first and second flexible and inflatable members, wherein, in use, said accumulator receives compressed gas at a relatively low flow rate and supplies the compressed gas to the flexible and inflatable members at a relatively high flow rate.

19. A gas actuator according to claim 18, wherein said accumulator is a tube located proximate said first and second flexible and inflatable members.

20. A gas actuator according to claim 15, in which a valve is provided for each of said flexible and inflatable members, the valve being supplied with compressed gas and including a restrictor whereby, in use, the restrictor controls the exit of compressed gas from the flexible and inflatable member which is deflating during pivotal movement of said second member so as to cushion the pivoting of said second member proximate to the first and second positions.

21. A gas actuator according to claim 20, comprising a valve timing means for each of the valves, the valve timing means controlling the actuation of the valves according to the position of said second member, whereby, in use, the valve timing means controls the magnitude of said force applied by said first and second flexible and inflatable members respectively, for a portion of the pivoting of the second member.

22. A gas actuator according to claim 21, wherein the proportion of the pivoting is between an initial 5% and 50% of the distance of pivoting from one of said first and second positions to the other of said first and second positions.

23. A gas actuator according to claims 15, further comprising a latching means for releasably locking said second member in said second position.

24. A gas actuator according to claim 23, wherein the latching means includes a first element for capturing the second member at the end of its pivoting to the second position, and a second element for releasing the second member for pivoting back toward said first position, wherein, in use, the releasing by the second element is caused by inflation of said second flexible and inflatable member.

25. A gas actuator according to claim 15, further comprising a source of compressed gas selected from a group consisting of:

a gas compressor located remotely from said first member;

a gas compressor located within said first member;

a cylinder of compressed gas located remotely from said first member; and a cylinder of compressed gas located with the first member.

26. A gas actuator according to claim 25, wherein the source, of compressed gas contains sufficient compressed gas for activating said first and second inflatable members for pivoting said second member between said first and second positions once or twice.

27. A gas actuator according to claim 26 further comprising means for sequentially coupling respective ones of a plurality of said cylinders of compressed gas to said flexible and inflatable member.

28. A gas actuator according to claim 15 wherein said flexible and inflatable member has a substantially flat shape when deflated and a substantially circular shape in cross-section when inflated, and said flexible and inflatable member. is located between, and, fixed tangentially to said first and second surfaces.

29. A gas actuator according to claim 28 wherein said first and second members are coupled by a pivot and said flexible and inflatable member is located proximate said pivot.

30. A gas actuator comprising:

a first member having a first surface;

a second member having a second surface, said first and second members being pivotally coupled together to allow said second member to pivot with respect to said first member between a first and second position;

a flexible and inflatable member disposed between said first and second surfaces and adapted for exerting a force therebetween to pivot said second member from said first position to said second position; and, means for controlling the magnitude of said force in such a manner that the magnitude of said force increases to a maximum and thereafter decreases prior to said second member reaching said second position, said gas actuator further comprising a second flexible and inflatable member, said second flexible and inflatable member being disposed for pivoting said second member from said second position toward said first position and a latching means for releasably locking said second member in said second position, said latching means including a first element for capturing said second member when in said second position, and a second element for releasing said second member for pivoting back toward said first position wherein, in use, the releasing by said second element is caused by inflation of said second flexible and inflatable member.

31. A gas actuator comprising:

a first member having a third and a fourth surface portion, said first and second members being pivotally coupled together to allow said second member to pivot with respect to said first member between a first position in which said first and third surface portions are substantially parallel and a second position in which said second and fourth surface portions are substantially parallel;

a first flexible and inflatable member disposed between said first and third surface portions, and adapted for exerting a force therebetween to pivot said second member to said second position;

a second flexible and inflatable member disposed between said second and fourth surface portions and adapted for exerting a force therebetween to pivot said second member to said first position; and, means for controlling the magnitude of said force exerted by said first flexible and inflatable member in such a manner that the magnitude of said force increases to a maximum and thereafter decreases prior to said second member reaching said second position and a valve provided for each of said flexible and inflatable members, the valve being supplied with compressed gas and including a restrictor whereby, in use, the restrictor controls the exit of compressed gas from the flexible and inflatable member which is deflating during pivotal movement of said second member so as to cushion the pivoting of said second member proximate to the first and second positions.

32. A gas actuator comprising:

a first member having a first and a second surface portion;

a second member having a third and a fourth surface portion, said first and second members pivotally coupled together to allow said second member to pivot with respect to said first member between a first position in which said first and third surface portions are substantially parallel and a second position in which said second and fourth surface portions are substantially parallel;

a first flexible and inflatable member disposed between said first and third surface portions, and adapted for exerting a force therebetween to pivot said second member to said second position;

a second flexible and inflatable member disposed between said second and fourth surface portions and adapted for exerting a force therebetween to pivot said second member to said first position; and, means for controlling the magnitude of said force exerted by said first flexible and inflatable member in such a manner that the magnitude of said force increases to a maximum and thereafter decreases prior to said second member reaching said second position, said gas actuator further comprising a latching means for releasably locking said second member in said second position and the latching means including a first element for capturing the second member at the end of its pivoting to the second position, and a second element for releasing the second member for pivoting back toward said first position, wherein, the use, the releasing by the second element is caused by inflation of said second flexible and inflatable member.

* * * * *